United States Patent [19]

Savage et al.

[11] 4,243,331

[45] Jan. 6, 1981

[54] APPARATUS FOR ADJUSTING A CARRIAGE RELATIVE TO A PLATEN

[75] Inventors: James G. Savage, Newark; Brian E. Jagger, Union City, both of Calif.

[73] Assignee: Xerox Corporation, Stamford, Conn.

[21] Appl. No.: 24,804

[22] Filed: Mar. 28, 1979

[51] Int. Cl.[3] ..... B41J 11/20

[52] U.S. Cl. ..... 400/59; 400/57; 400/166; 101/93.03

[58] Field of Search ..... 400/59, 55, 56, 57, 400/124, 157.3, 166; 101/93.03

[56] References Cited

U.S. PATENT DOCUMENTS

| | | | |
|---|---|---|---|
| 3,239,049 | 3/1966 | Voit, Jr. | 400/56 |
| 3,776,341 | 12/1973 | Dobner et al. | 400/157.3 |
| 3,960,256 | 6/1976 | Bickoff et al. | 400/124 |
| 3,983,803 | 10/1976 | Thomas | 400/59 |
| 4,012,265 | 7/1978 | Deetz | 400/166 |
| 4,023,662 | 5/1977 | Perucca | 400/59 |
| 4,086,997 | 5/1978 | Wu | 400/59 |
| 4,134,692 | 1/1979 | Suzuki et al. | 400/57 |

FOREIGN PATENT DOCUMENTS

| | | | |
|---|---|---|---|
| 2726462 | 12/1978 | Fed. Rep. of Germany | 400/166 |
| 2752061 | 5/1979 | Fed. Rep. of Germany | 400/59 |

OTHER PUBLICATIONS

Frechette, "Automatic Impression Control", Xerox Disclosure Journal, vol. I, No. 7, p. 31, 7/76.

Abraham, et al., "Multiple Energy Print Hammer", IBM Technical Disclosure Bulletin, vol. 15, No. 1, p. 202, 6/72.

Blaskovic, et al., "Print Head . . . Separation", IBM Technical Disclosure Bulletin, vol. 20, No. 11A, p. 4270, 4/78.

*Primary Examiner*—William Pieprz

[57] ABSTRACT

Apparatus for adjusting a carriage assembly in a printing relationship to a platen. The carriage supports the printing mechanism including a print element. The distance between the carriage with the print element and the platen is adjusted by the adjustment apparatus, which rotates the carriage about a first support rail by changing the distance between the carriage and a second support rail.

5 Claims, 8 Drawing Figures

APPARATUS FOR ADJUSTING A CARRIAGE RELATIVE TO A PLATEN

The invention relates to apparatus for adjusting the printer carriage assembly relative to the platen. A print element is mounted on the carriage and positioned in printing relationship with the platen. The carriage is rotated about one of the mounting means by the position adjustment apparatus whereby the print element is adjustably positioned with respect to the platen.

In modern serial printer applications, there is a demand for versatility in the number of copies to be printed. Some applications require only one copy whereas others will require as many as six or more copies. It is common in printing to supply multiple copies in a single printing by interleaving several sheets of print receiving medium with several carbon papers. This multiple copy document as well as the single copy document is then inserted into the serial printer between the platen and the printing means including the ribbon, print element and print hammer assembly. The amount of impact energy needed to print six or more legible copies is considerably greater than to print a single copy. While impact energy for printing one copy may be insufficient for printing six copies, impact energy for printing six copies could result in the cutting of the ribbon and/or the print receiving medium in the case of printing a single copy.

As it is common to insert from one to six or more print receiving sheets and carbons in a serial printer at one time, it would be desirable to provide a means for varying the available space between the platen and the printing means including the ribbon, print element and print hammer assembly, thereby making it easier for the operator to insert the desired sheets into the printer without damaging the sheets or the various elements in the printer. With this capability being provided, it would then be desirable to change the amount of impact energy provided by the hammer assembly depending upon the number of copies to be printed thereon.

As disclosed in U.S. Pat. No. 3,239,049, a printer employing a ball-type print element utilizes an impression control mechanism for selecting one of a plurality of cams, which results in driving the ball-type element against the platen with a different force of impact dependent upon the cam which is chosen. U.S. Pat. No. 4,102,265 discloses circuitry, which controls the amount of impact energy supplied by the hammer assembly depending upon the character to be printed. U.S. Pat. No. 3,144,821 discloses the use of a hammer impression control means having a plurality of integral energy absorbing portions, each adapted to coact with a separate hammer element. U.S. Pat. No. 4,063,630 discloses a single element printing mechanism, which is pivotable about the centerline of the curved platen to an optimum print line viewing position.

The invention as claimed solves the problems of providing a varying distance between the platen and the ink ribbon, print element and hammer assembly depending upon the number of sheets of print receiving medium upon which printing is to occur. Also, as the distance is varied, the impact energy is changed to thereby provide impact energy in relation to the number of documents to be printed upon.

The advantages offered by the invention are mainly that the adjustment of the carriage relative to the platen is provided in a position manner and is a simple operator adjustment. The impact energy provided by the hammer assembly is automatically changed along with the change in position. The position adjustment apparatus will move in various directions as the carriage moves along the platen and will follow the rail without binding even if the two rails are in misalignment.

One way of carrying out the invention is described in detail below with reference to drawings, which illustrate only one specific embodiment, in which.

Figure 1:
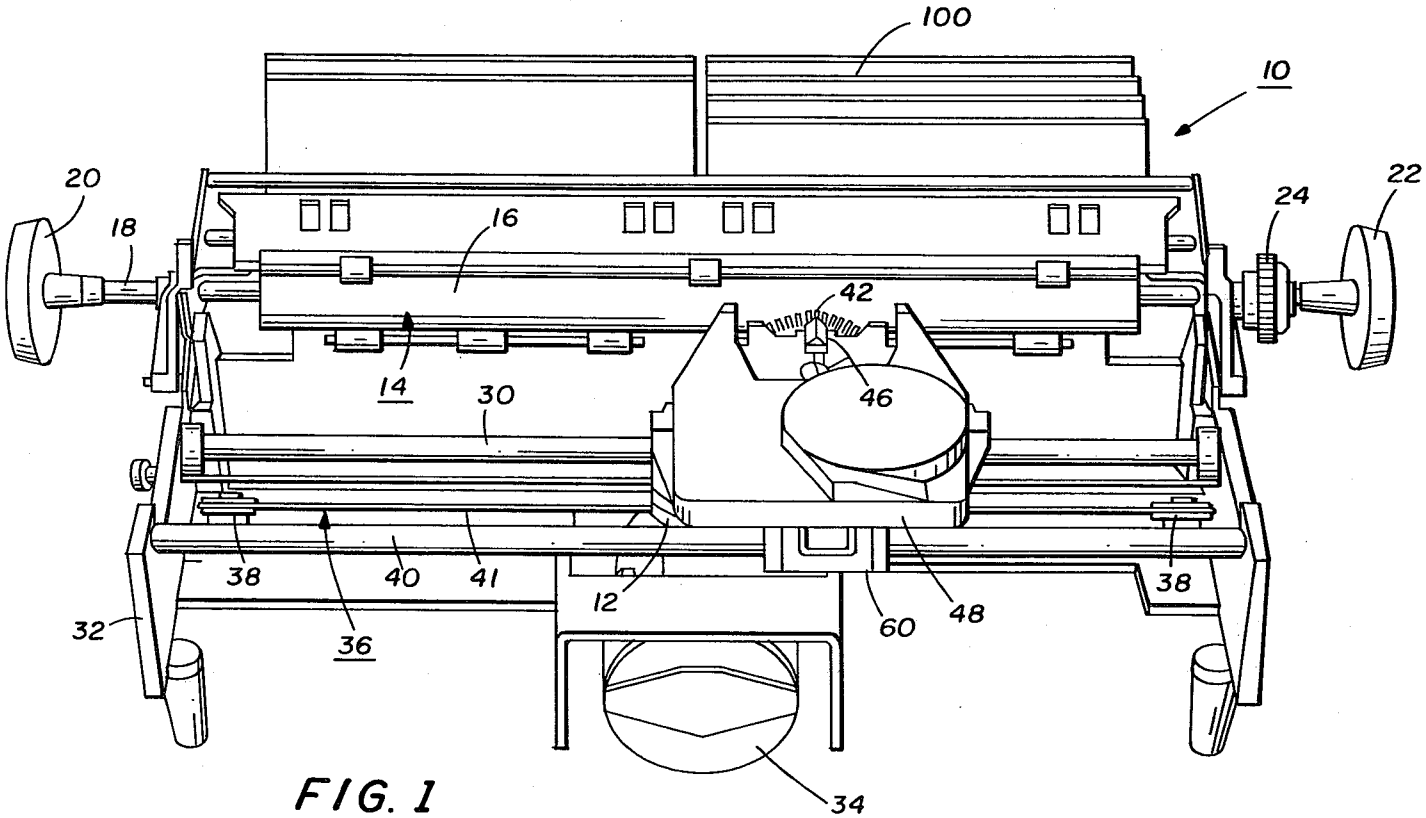
FIG. 1 is a top plan view of a printer embodying the present invention.

Referring to FIG. 1, a serial printer 10 includes a carriage assembly 12 shown incorporating the present invention, which will be described in detail below. The printer 10 also includes a conventional platen feed assembly 14, which comprises a platen 16 mounted to a rotatable shaft 18 for rotation therewith. Mounted at each end of the shaft 18 are a pair of knobs 20 and 22 for enabling the manual rotation of the shaft 18 and platen 16. The knob 20 is fixed relative to the shaft 18, and the knob 20 is movable axially of the shaft between first and second positions. When in a first position, a gear-drive assembly 24 mounted about the shaft 18, adjacent the knob 22, is engaged with the shaft so that a motor-gear arrangement (not shown) coupled to the gear-drive assembly 24 controls the automatic rotation of the shaft 18. When in a second position, the knob 22 disengages the gear-drive assembly 24 from the shaft so that manual rotation of the knobs 20 and 22 will cause a corresponding rotation of the shaft 18 and platen 16.

Still referring to FIG. 1, a drive motor 34 is coupled by a suitable cable-pulley arrangement 36 to the carriage assembly 12. As is conventional, the cable-pulley arrangement 36 includes a first pulley (not shown) connected to the shaft of the drive motor 34, a plurality (e.g., two or four) of second pulleys 38 coupled to opposing sides of the machine frame 32 and a third pulley (not shown) connected to the carriage assembly 12 near the lower or rear rail 30. At least cable 41 is wrapped around the pulleys for imparting linear motion to the carriage assembly 12 along the upper or front rail 40 and the lower or rear rail 30 in response to rotation of the drive shaft, together with the third pulley, (not shown) of the carriage drive motor 34.

Figure 2:
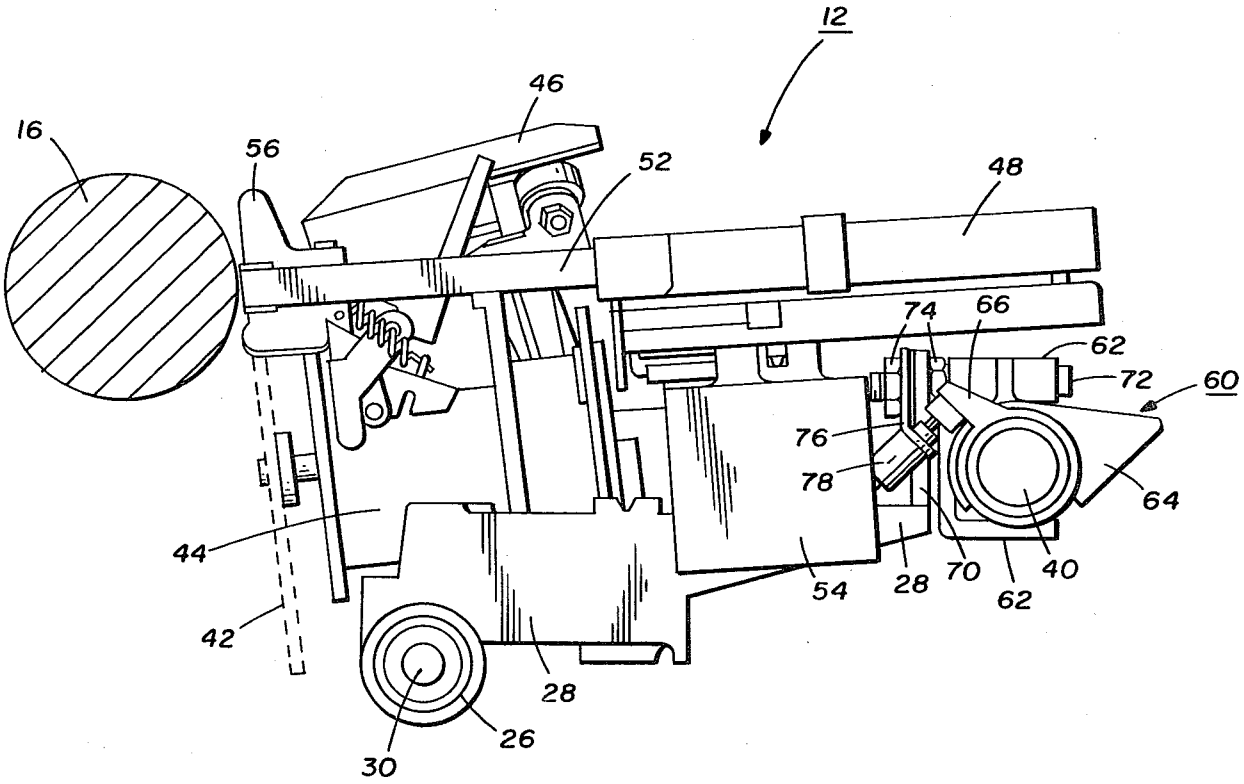
FIG. 2 is a side plan view of the carriage of the printer of FIG. 1.

Referring now to FIGS. 1 and 2, the carriage assembly 12 generally includes and is adapted to transport a print wheel 42, which is preferably of the daisy wheel type, and which is mounted to a drive motor 44 for rotation about its axis, a drive motor 44 for controlling the direction and speed of rotation of the print wheel 42, a hammer assembly 46 for impacting an aligned character element on the print wheel 42 against the print receiving medium (not shown) supported on the platen 50, a ribbon cartridge 48 for supplying linked ribbon 52 between the hammer assembly 46 and the platen 16, and a ribbon drive motor 54 for transporting ribbon 52 in front of the hammer assembly 46 along a pair of ribbon guides 56 (only one visible) during operation of the printer.

The carriage assembly 12 also includes a main frame assembly 28 and is mounted for escapement motion along the platen 16 by a lower or rear bearing member 26 to a lower or rear rail 30 and by the position adjustment apparatus 60 to the upper or front rail 40; lower or rear bearing member 26 and position adjustment apparatus 60 being mounted to portions of the main frame assembly 28.

With particular reference to the mounting of the position adjustment apparatus 60 to the carriage main frame assembly 28, as shown in FIG. 2, a vertical member 70 extends from frame assembly 28. Vertical member 70 contains an aperture (not shown) in the outer portion thereof through which post 72 is removably attached by fasteners or nuts 74. Bracket 76 is also removably attached to vertical member 70 by post 72 and fasteners 74. Switch 78 is attached to bracket 76 and is positioned to be operated by the rotational movement of arm 66. Cradle 62 has an aperture or opening 96 (see FIG. 6) through which post 72 is disposed. This mounting of cradle 62 provides for possible movement of cradle 62 in an axial direction with respect to post 72 as well as movement in a rotational direction with respect to post 72. The upper or front rail 40 is disposed through the bore or aperture 90 of the upper bearing assembly 68. The upper bearing assembly 68 is fitted into the open portion of cradle 62 and coacts therewith in a manner to be detailed below. The cradle 62 maintains a force against the upper bearing assembly 68 to maintain a stable positional relationship therewith.

Figure 3:
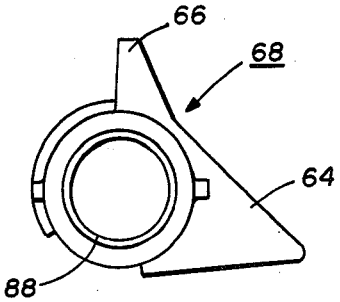
FIG. 3 is a side plan view of the upper bearing assembly.
Figure 4:
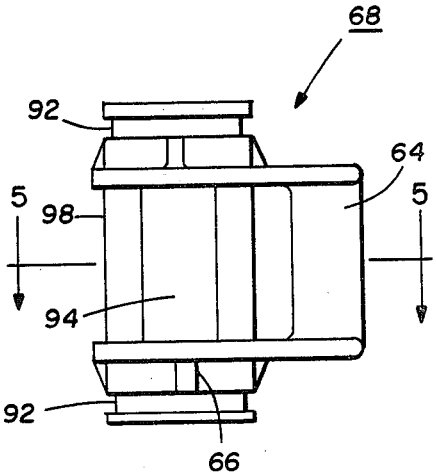
FIG. 4 is a top plan view of the upper bearing assembly.
Figure 5:
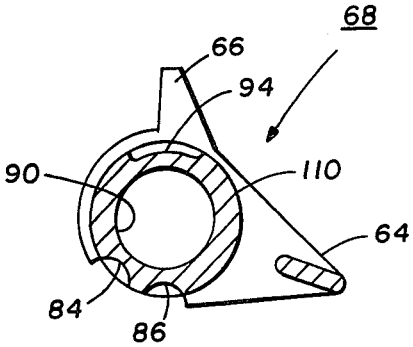
FIG. 5 is a simplified side sectional view of the upper bearing assembly taken generally along line 5—5 of FIG. 4.

The details of the position adjustment apparatus 60 are shown in FIGS. 3 through 7. As shown in FIGS. 3 through 5, the upper bearing assembly 68 comprises a generally elongated tubular housing 98 having a bore or aperture 90 therethrough. Bearings 88 (only one shown) are pressed into each end of housing 98 and have aligned central openings through which the upper or front rail 40 is disposed in contacting relatively movable relation. Arm 66 and handle 64 protrude radially from housing 98. A pair of annular notches 92 are formed in the outer wall of housing 98 adjacent respective opposing ends of housing 98. The annular notches 92 are for receiving wiper rings and dust caps (not shown) to keep dirt and debris from entering the ends of housing 98. A first trough 84 and a second trough 86 are formed in the axial direction in the outer surface of housing 98 and extend substantially the same distance as handle 64. A cutout 94 is also formed in the axial direction in the outer surface of housing 98 and extends substantially the same distance as handle 64. The upper bearing assembly 68 is preferably injection molded of polycarbonate LEXAN 500.

Figure 6:
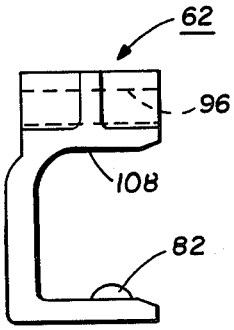
FIG. 6 is a side plan view of the cradle.
Figure 7:
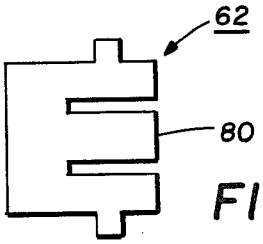
FIG. 7 is a bottom plan view of the cradle.

As shown in FIGS. 6 and 7, cradle 62 is generally C-shaped in appearance with an aperture or opening 96 therethrough to coact with post 72. A spherical surface 82 is formed on tang 80 of cradle 62 and coacts with troughs 84 and 86. Cradle 62 is preferably injection molded of DELRIN AF113.

With reference again to FIG. 2, the position adjustment apparatus 60 comprises cradle 62, which maintains a position around the upper bearing assembly 68 and operates in conjunction with post 72 and upper or front rail 40 to rotate carriage 12 about and with respect to the lower or rear rail 30 to position the print wheel 42 and associated hammer assembly 46 closer to or further from platen 16. Handle 64 is capable of being placed in one of two different positions at any given time by the operator. When handle 64 is placed in the up position, spherical surface 82 is positioned to fit into trough 84. Spring force from tang 80 maintains spherical surface 82 in contact with trough 84. Surface 110 of upper bearing assembly 68 is in contact with surface 108 of cradle 62. This relationship between cradle 62 and the upper bearing assembly 68 places the print wheel 42 a predetermined distance from the platen 16. This is the position chosen for printer operation when one to three sheets of typical print receiving medium are to be supported on the platen 16 for printing thereon. Arm 66 activates switch 78 and closes the contacts thereof.

When the operator rotates handle 64 to the down position, trough 84 is removed from contact with spherical surface 82, and spherical surface 82 then fits into trough 86, which is more shallow in depth than trough 84. Surface 108 of cradle 62 is now in contact with the surface of cutout 94. This relationship causes cradle 62 to move in a downwardly direction with respect to its previous position and with respect to the stationary position of the upper or front rail 40. Of course, when the cradle 62 moves downward, the carriage assembly rotates clockwise with respect to the lower or rear rail 30, and this causes the print wheel 42 to be removed a greater distance from the platen 16 than the distance previously set. This is the position chosen for operation when four to six sheets of typical print receiving medium are supported on the platen 16 for printing thereon through the use of carbons, etc. Arm 66 is now in a position such that switch 78 is no longer activated, and the switch contacts are now open.

Figure 8:
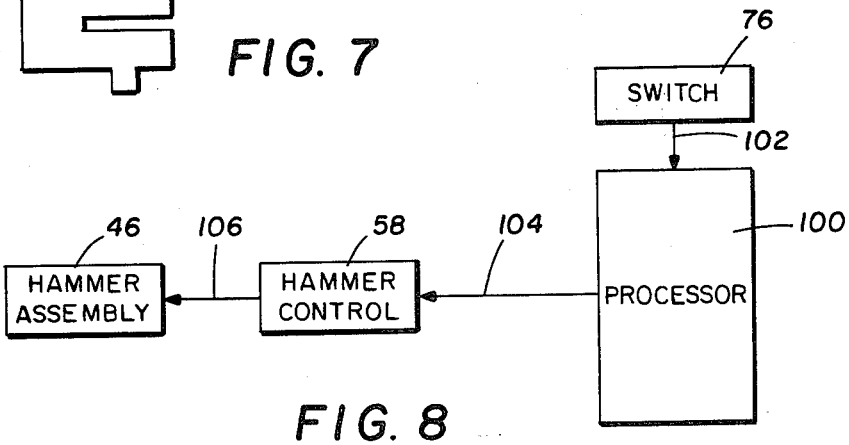
FIG. 8 is a simplified schematic of the hammer intensity selection means.

In order to assure acceptable print quality of printing on the first sheet and succeeding carbon copies during the printing operation in both of the two possible positions of the print wheel 42 and the hammer assembly 46, it is desirable to control the impact energy provided by the hammer assembly 46 and provide different impact energies from the hammer assembly 46 for each of the two positions of the position adjustment apparatus 60. With reference to FIG. 8, the condition of the contacts of switch 78 is transmitted over line 102 to processor 100 in serial printer 10. Processor 100 comprises means responsive to the condition of the contacts (open or closed) of switch 78 for generating a predetermined signal representative of the desired level of force with which character element on print wheel 42 is to be impacted by the print hammer assembly 46. The predetermined signal from processor 100 is transmitted over line 104 to the hammer control 58 whose output is transmitted over line 106 to the print hammer assembly 46. The operation of the serial printer 10, together with details of the operation of a typical processor 100 and control of the desired level of force to be provided by the hammer assembly, is described in detail in commonly assigned U.S. Pat. No. 4,037,208 of Alfred G. Osterlund et al, which issued on July 19, 1977, on a "Hammer Intensity Selection Apparatus for Serial Printer". Hence, that patent is hereby incorporated by reference.

It will be appreciated that there has been shown an illustrative arrangement for use in a serial printer where position adjustment apparatus provides for a positive acting, easily operatable means of adjusting the carriage assembly relative to the platen. The position adjustment apparatus also provides the support function between the frame of the carriage and one of the support rails. The support function allows movement in two planes to follow the support rail without binding even if there is a small amount of misalignment between the two support rails.

Although the present invention has been described with reference to a presently preferred embodiment, it will be appreciated by those skilled in the art that various modifications, alternatives, variations, etc., may be made without departing from the spirit and scope of the invention as defined in the appended claims.

What is claimed is:

1. Apparatus for adjusting a carriage assembly in a printing relationship to a platen, said apparatus comprising:

a printing mechanism supported on said carriage assembly and including a print element and a print hammer assembly, a first support rail located in a first plane, means for connecting said carriage to said first support rail for linear and rotational movement with respect to said first support rail, a second support rail substantially parallel to said first support rail, support means extending from said carriage assembly and oriented in a second plane substantially perpendicular to said first plane, an elongate tubular housing having opposing normally open ends through which said second support rail is disposed in contacting relatively movable relation, said elongate tubular housing includes at least two trough-shaped depressions of different depths formed at predetermined locations in the outer surface thereof and a cutout portion forming another depression located at a different predetermined location in the outer surface thereof, and a generally C-shaped member positioned to fit around said tubular housing in a supporting relationship and capable of relative rotational movement therebetween, said C-shaped member being supported from said support means for pivotal movement therefrom in said first plane and supported therefrom for translational movement in said second plane, whereby the distance between said carriage assembly and said platen is varied upon relative rotational movement between said tubular housing and said C-shaped member.

2. Apparatus as recited in claim 1, wherein said C-shaped member includes a spherical surface for coacting with said trough-shaped depressions and a plane surface to coact with said cutout portion, whereby said carriage assembly is moved in a rotational direction with respect to said first support rail when said spherical surface is in contact with either of said trough-shaped depressions.

3. Apparatus as recited in claim 1, wherein said tubular housing includes an arm protruding radially outwardly from said housing, said arm being positioned to be capable of activating a switch whereby an indication is provided as to the position of the carriage relative to the platen.

4. Apparatus as recited in claim 3, wherein said switch is electrically connected to a processor in a printer containing said carriage assembly, whereby the processor provides an output to said print hammer assembly to control the level of force provided for printing by the print hammer assembly.

5. A serial printer for printing information on a record material comprising:

a frame, a platen mounted to said frame for rotation about its axis, said platen capable of supporting and advancing record material through said printer, a carriage assembly having a print element and a print hammer assembly supported thereon, said carriage assembly being supported on a first support rail for movement along a printing path adjacent said platen, said first support rail being located in a first plane, a second support rail positioned essentially parallel to said first support rail, support means extending from said carriage assembly and oriented in a second plane substantially perpendicular to said first plane, an elongate tubular housing having opposing normally open ends through which said second support rail is disposed in contacting relatively movable relation, said elongate tubular housing includes at least two trough-shaped depressions of different depths formed at predetermined locations in the outer surface thereof and a cutout portion forming another depression located at a different predetermined location in the outer surface thereof, and a generally C-shaped member positioned to fit around said tubular housing in a supporting relationship and capable of relative rotational movement therebetween, said C-shaped member being supported from said support means for pivotal movement therefrom in said first plane and supported therefrom for translational movement in said second plane, said C-shaped member includes a spherical surface for coacting with said trough-shaped depressions and a plane surface to coact with said cutout portion, whereby said carriage assembly is moved in a rotational direction with respect to said first support rail when said spherical surface is in contact with either of said trough-shaped depressions, whereby the distance between said carriage assembly and said platen is varied upon relative rotational movement between said tubular housing and said C-shaped member.

* * * * *